US009427802B2

(12) United States Patent
Svensson et al.

(10) Patent No.: US 9,427,802 B2
(45) Date of Patent: Aug. 30, 2016

(54) COMPOSITE CAST TOOL

(75) Inventors: Christer Svensson, Karlsham (SE); Tomas Nilsson, Katrineholm (SE)

(73) Assignee: Verktygs Allians i Hässleholm AB, Hässleholm (SE)

( * ) Notice: Subject to any disclaimer, the term of this patent is extended or adjusted under 35 U.S.C. 154(b) by 51 days.

(21) Appl. No.: 12/920,886

(22) PCT Filed: Mar. 5, 2009

(86) PCT No.: PCT/SE2009/000123

§ 371 (c)(1),
(2), (4) Date: Nov. 15, 2010

(87) PCT Pub. No.: WO2009/123524

PCT Pub. Date: Oct. 8, 2009

(65) Prior Publication Data

US 2011/0052933 A1 Mar. 3, 2011

(30) Foreign Application Priority Data

Mar. 6, 2008 (SE) ..... 0800521

(51) Int. Cl.
*B22D 19/16* (2006.01)

(52) U.S. Cl.
CPC ..... *B22D 19/16* (2013.01); *Y10T 428/12389* (2015.01); *Y10T 428/12958* (2015.01)

(58) Field of Classification Search
CPC ..... B22D 19/16
USPC ..... 164/91–112
See application file for complete search history.

(56) References Cited

U.S. PATENT DOCUMENTS

| | | | | |
|---|---|---|---|---|
| 95,577 | A * | 10/1869 | Foster | 164/96 |
| 1,787,526 | A * | 1/1931 | Honstain | 164/111 |
| 2,163,022 | A * | 6/1939 | Campbell | 164/95 |
| 3,752,212 | A * | 8/1973 | Thompson | 164/93 |
| 2005/0061129 | A1* | 3/2005 | Berg et al. | 83/658 |
| 2008/0058108 | A1* | 3/2008 | Lin | F16D 3/387 464/134 |
| 2011/0120664 | A1* | 5/2011 | Svensson et al. | 164/6 |

(Continued)

FOREIGN PATENT DOCUMENTS

| | | | |
|---|---|---|---|
| AU | 583655 | B | 5/1989 |
| DE | 806037 | C | 6/1951 |
| JP | 55-081061 | * | 6/1980 |

(Continued)

OTHER PUBLICATIONS

International Search Report for corresponding International App. PCT/SE2009/000123.
JP3189065 A, Takagi Chuko KK, Aug. 19, 1991 (abstract).
JP2004255424 A, Asai Takashi, Sep. 16, 2004 (abstract).

*Primary Examiner* — Humera Skeikh
*Assistant Examiner* — Lucas Wang
(74) *Attorney, Agent, or Firm* — WRB-IP LLP

(57) ABSTRACT

A composite cast tool is cast in one continuous piece, partly of steel and partly of grey iron, so that an interconnection zone is formed between the steel and the grey iron. The steel portion forms the working component of the tool, for example a cutting edge, and the grey iron portion forms the body component of the tool. The steel portion and the grey iron portion have projections or walls extending towards one another. The interconnection zone is located in the region of union between these walls and is planar.

6 Claims, 5 Drawing Sheets

(56) References Cited

U.S. PATENT DOCUMENTS

2011/0123828 A1* 5/2011 Svensson et al. ..... 428/682
2011/0185857 A1* 8/2011 Svensson et al. ..... 76/101.1

FOREIGN PATENT DOCUMENTS

JP 58-032543 * 2/1983
WO 03041895 A1 5/2003

* cited by examiner

COMPOSITE CAST TOOL

The present application is the U.S. national stage of International Application PCT/SE2009/000123, filed Mar. 5, 2009, which claimed priority to Swedish Application 0800521-7, filed Mar. 6, 2008, both of which are incorporated by reference.

BACKGROUND AND SUMMARY

The present invention relates to a composite cast tool which is cast in one continuous piece and which has at least one first portion which comprises the working component of the tool and which is manufactured from steel, and one second portion which comprises the body component of the tool and which is manufactured from grey cast iron, there being at least one interconnection zone between the steel and the grey iron.

In the manufacture of tools for sheet metalworking, such as cutting, hole making, bending or other shaping operations, it has long generally been the practice to separately manufacture a tool body by casting it from grey iron. This tool body has then been provided with a number of working components, for example steel cutters.

The tool body produced by casting has often required heat treatment after the casting operation, this being followed by machining in order to realise the requisite seats, guide shafts and bolt holes etc. for securing the steel cutters, but also to make possible fixing of the tool in a machine.

In the production of the working component or components, for example the steel cutters, the point of departure has often previously been bar material, the working components being machined to the correct form, provided with apertures for fixing bolts, guide shafts and the like, thereafter, heat treatment takes, followed by machining, for example grinding.

Producing a tool in the above-outlined manner is an extremely time-consuming operation and often determines itself the time consumption which is needed for the new production of different products.

WO 03/041895 A1 discloses a composite cast tool, as well as a method of its manufacture. According to this publication, the tool is cast in a single mould, which is thus charged with both the steel melt and the grey iron melt. During the casting of these materials, an interface or interconnection zone is formed.

In the prior art technology according to the above-mentioned publication, major problems have been encountered as regards the positioning and formation of the interface or interconnection zone between the two materials. This has had a negative effect on mechanical strength in and around the interconnection zone.

Further, it has not been possible according to the prior art technology to control in an accurate manner the temperature throughout the entire interconnection zone, which has had as a consequence that major temperature variations have occurred and resultant problems in the mechanical strength of the interconnection zone.

It is desirable to design the tool intimated by way of introduction such that the interface or interconnection zone between the steel and the grey iron may be accurately positionally determined. It is also desirable to design the tool so that it may be possible to ensure good control of the temperature at the interconnection zone.

According to an aspect of the present invention, a tool is characterised in that the first portion includes at least one projection or one wall which extends towards the body component, that the second portion includes at least one projection or one wall which extends towards the working component, corresponding projections or walls on the first and second portions being united with one another at the interconnection zone, and that the interconnection zone is substantially planar.

BRIEF DESCRIPTION OF THE ACCOMPANYING DRAWINGS

The present invention will now be described in greater detail hereinbelow, with reference to the accompanying Drawings. In the accompanying Drawings.

DETAILED DESCRIPTION

Figure 1:
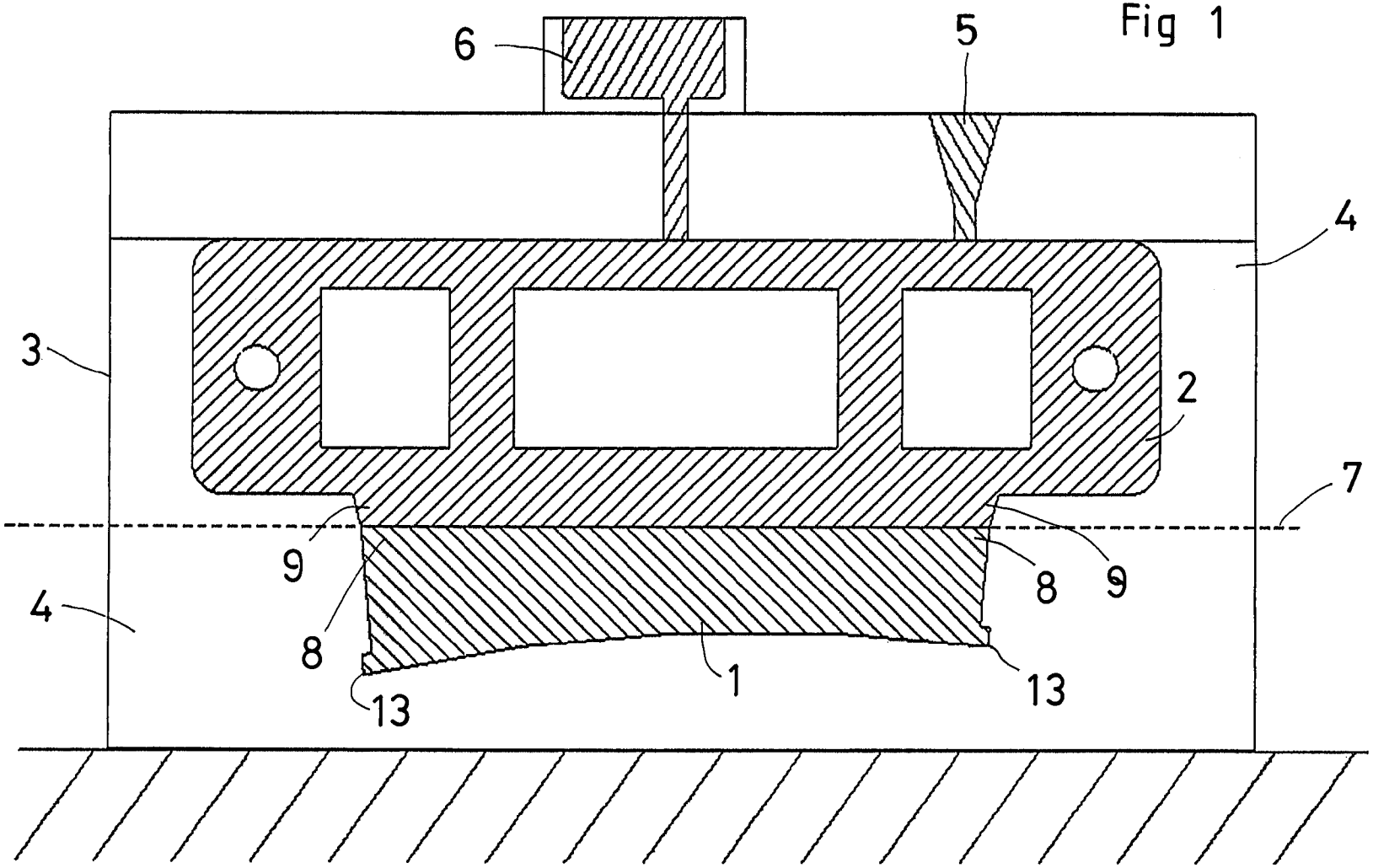
FIG. 1 is a cross section through a mould for manufacturing the tool according to the present invention.

FIG. 1 schematically shows a cross section through a mould for casting of the tool according to the present invention. The mould has a first mould cavity section 1 and a second mould cavity section 2, where the first mould cavity section 1 is intended for the casting of steel, while the second mould cavity section 2 is intended for the casting of grey iron. Reference numeral 3 relates to a casting box or flask, while reference numeral 4 relates to casting sand placed in the casting box. The mould has an ingate or sprue 5 for steel and another ingate or sprue 6 for the grey iron. The ingate system for the steel extends at least partly to a position down below the first mould cavity section 1, for which reason the steel will be cast in a direction from beneath and upwards. Between the two mould cavity sections 1 and 2, there is a dividing plane 7 which represents the intended position for an interconnection zone between the steel and the grey iron. The dividing plane 7 is planar and in the casting position of the mould is disposed horizontally. The interconnection zone will, if the present invention is correctly reduced into practice, have an approximate thickness of 1 to 2.5 mm.

The component or components 10 of the tool that are cast in steel, hence in the first mould cavity section or sections 1, are intended to constitute the working component or components of the tool, while that component 11 of the tool which is cast in the second mould cavity section 2 in grey iron, is intended to constitute a body component for the tool. How many working components the tool has may vary from a single component and upwards to quite a considerable number.

The steel component 10 cast in the first mould cavity section 1 includes at least one projection or one wall 8 which extends upwards towards the body component (the component manufactured from grey iron). Correspondingly, the second component 11 of the tool, i.e. the portion cast manufactured from grey iron, has one wall or projection 9 which extends in a direction downwards towards the working component of the tool or its working components. The width or thickness of these projections or walls 8, 9, in the region of the dividing plane 7 must be the same throughout the entire length of the projection or the wall, and, in one practical version, may lie in the order of magnitude of between 50 and 150 mm. Large or abrupt thickness changes in the walls 8 and 9 must not occur in the proximity of the dividing plane 7. If a plurality of projections or walls is used in a tool, all must have substantially the same thickness. The height of these walls 8 and 9 must be of the same order of magnitude as or be larger than the width or thickness, but never less than 30 to 40 $mm^2$.

Figure 2:
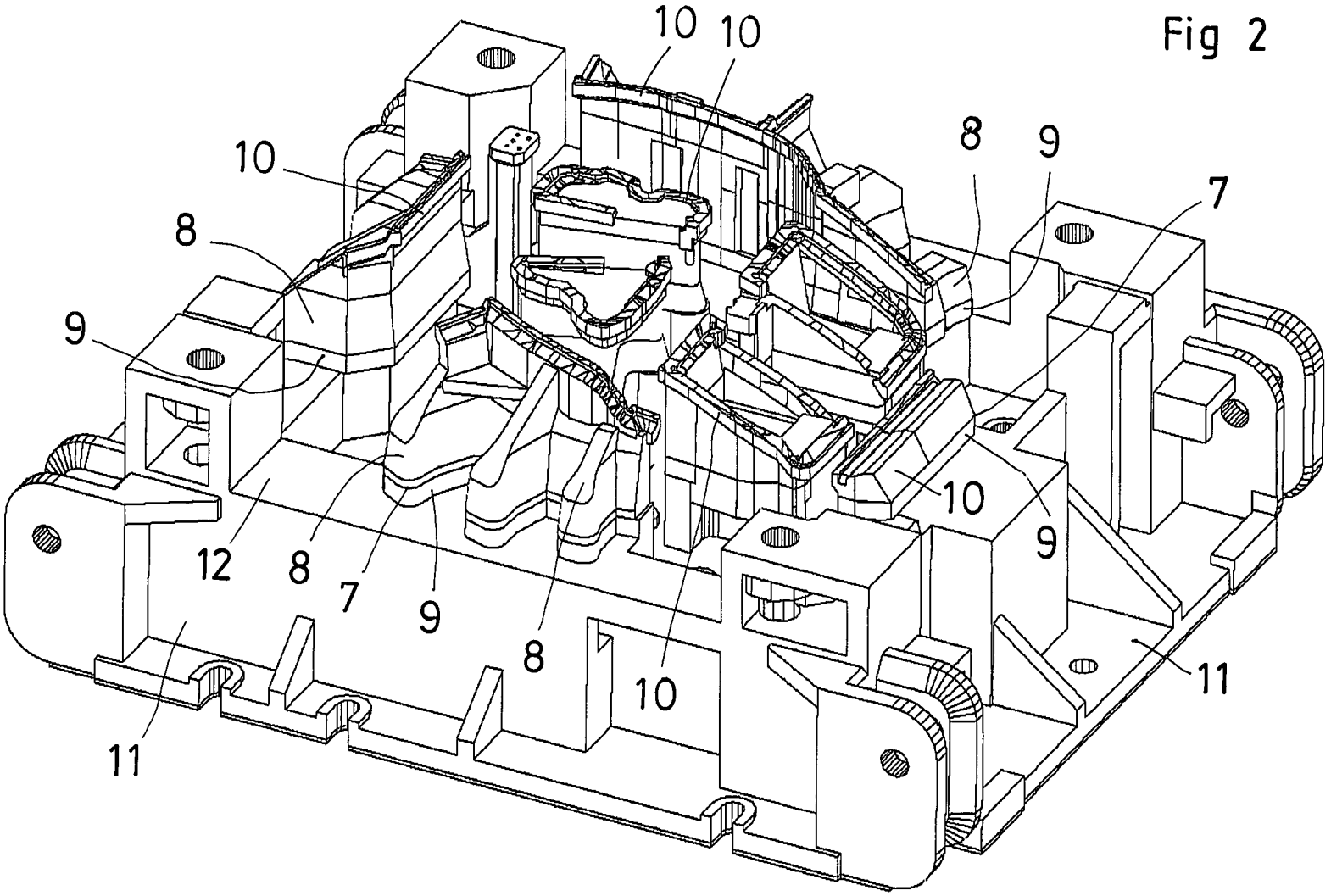
FIG. 2 is a perspective view of a tool which is inverted in relation to the position on its manufacture.
Figure 3:
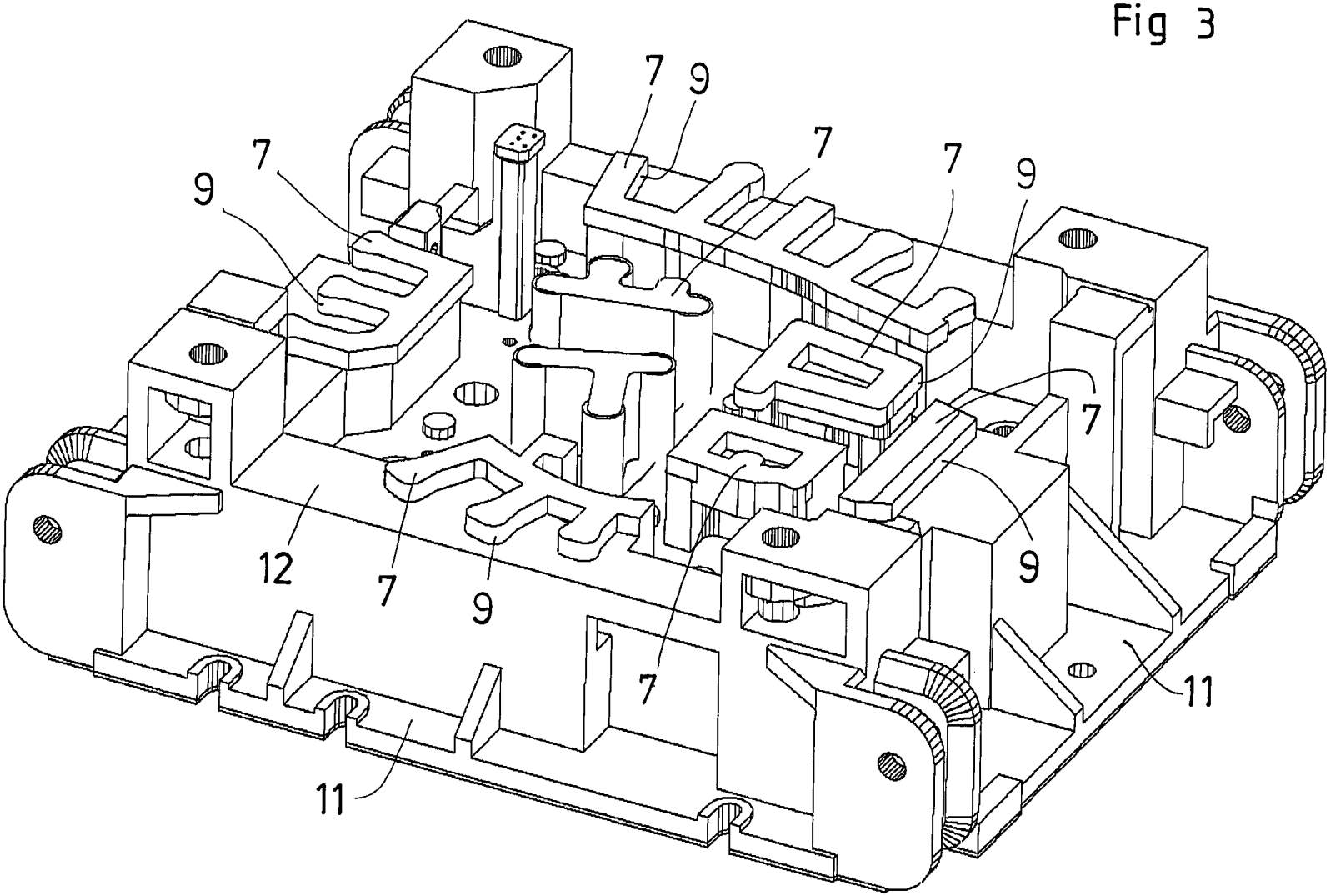
FIG. 3 is a part of the tool according to FIG. 2, all working components manufactured from steel having been removed.

FIGS. 2 and 3 are inverted compared with FIG. 1, hence that which faces upwards in FIGS. 2 and 3 is turned to face downwards in FIG. 1.

FIG. 2 shows in perspective a tool with eight first portions 10 manufactured from steel and one second portion 11 manufactured from grey iron. It will also be apparent from FIG. 2 that the portions 10 manufactured from steel have projections or walls 8 which, in FIG. 2, are located lowermost, thus are turned to face towards the second portion 11. Correspondingly, it will be apparent that the second portion 11 has, in a manner analogous with the first portions 10, upwards directed walls or projections 9 which are thus turned to face towards the first portions manufactured from steel. The ideal position for the interconnection zone between the two materials is indicated by the dividing plane 7.

In FIG. 3, which corresponds to FIG. 2 but where all portions 10 of the tool manufactured from steel have been 'omitted', the formation of the walls or projections 9 of the second portion 11 directed towards the working components are more clearly apparent. It is also apparent that the dividing plane 7 is planar and that the walls 9 are in principle of even thickness throughout their entire length.

It will also be apparent from FIG. 3 that the walls 9 of the second portion 11 merge in a much large cross-sectional area, at least at certain parts of the tool, and indicated by reference numeral 12. The position of this area change 12 is however located a safe distance (<approx. 40 $mm^2$) from the intended position of the interconnection zone, i.e. the dividing plane 7.

As was mentioned above, the steel is cast from beneath in the first mould cavity section 1. The casting of the steel is terminated when the upper defining surface of the steel has reached up to the position of the dividing plane 7. Thereafter, there is a pause in the casting process. During this pause, the temperature in the first portion 10 will fall most rapidly in the lower parts in FIG. 1 and last at the dividing plane 7. Only when the temperature of the steel portion 10 has fallen to a first level corresponding to the liquidus temperature of the steel minus approx. 30-150° C., most often for example 1440-1330° C., at the dividing plane, will the casting procedure be continued with casting of the grey iron at a second temperature, which corresponds to the liquidus temperature of the grey iron plus 100-150° C., for example 1320° C.

According to the present invention, it is important that the temperature in the steel portion 10 in the dividing plane be as uniform as possible throughout the entire surface of the dividing plane. This is the reason for the uniform thickness formation of both of the walls 8 and 9.

Figure 4:
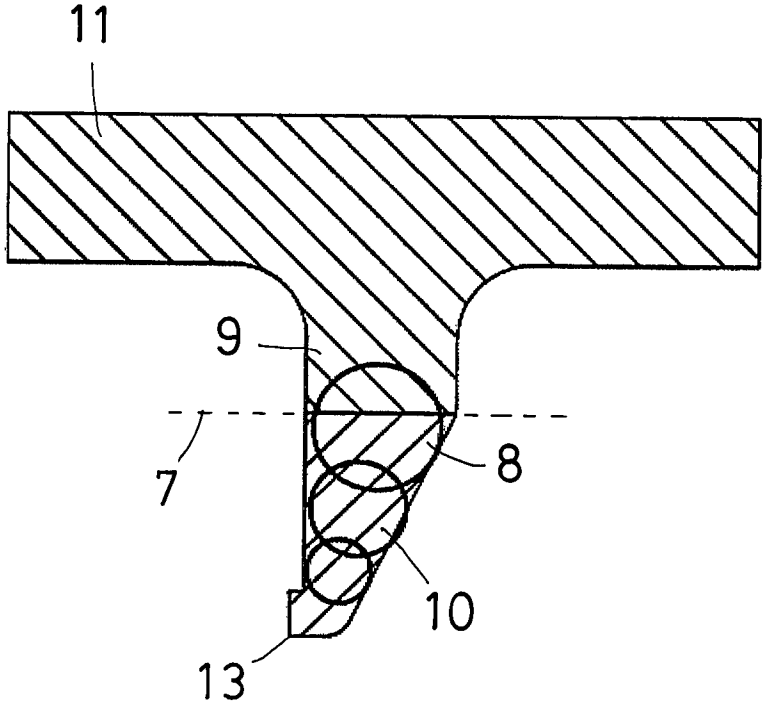
FIG. 4 is a cross section through a tool in the region of the interconnection zone.

FIG. 4 shows a partial section through a tool in the region of the dividing plane 7. The steel portion 10 has, in the illustrated example, been formed with a cutting edge 13 in its lower end in the Figure.

In order to ensure that the temperature, in terms of time, falls last in the steel portion 10 at the level of the dividing plane 7, the steel portion 10 has been given a wall thickness that is slightly tapering in a direction away from the dividing plane 7. This is illustrated by the added circles which have a size which increases in a direction from beneath and upwards. This formation is favourable for controlling the temperature reduction in the steel portion, but also implies that possible sinkages will be at the dividing plane 7.

Figure 5:
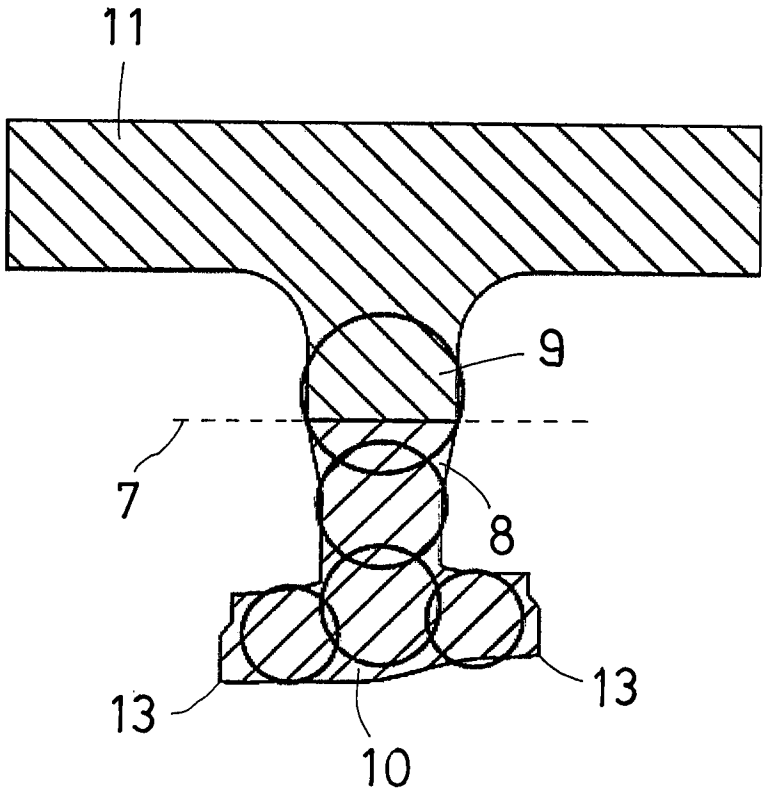
FIG. 5 is a cross section through an alternative tool in the region of the interconnection zone.

FIG. 5 shows a slightly modified embodiment of a double cutting tool with double cutting edges 13. Also in this embodiment, the thickness in the steel portion 10 declines a direction away from the dividing plane 7 in order, as is intimated by the added circles, to be least in the region at the cutting edges 13.

Figure 6:
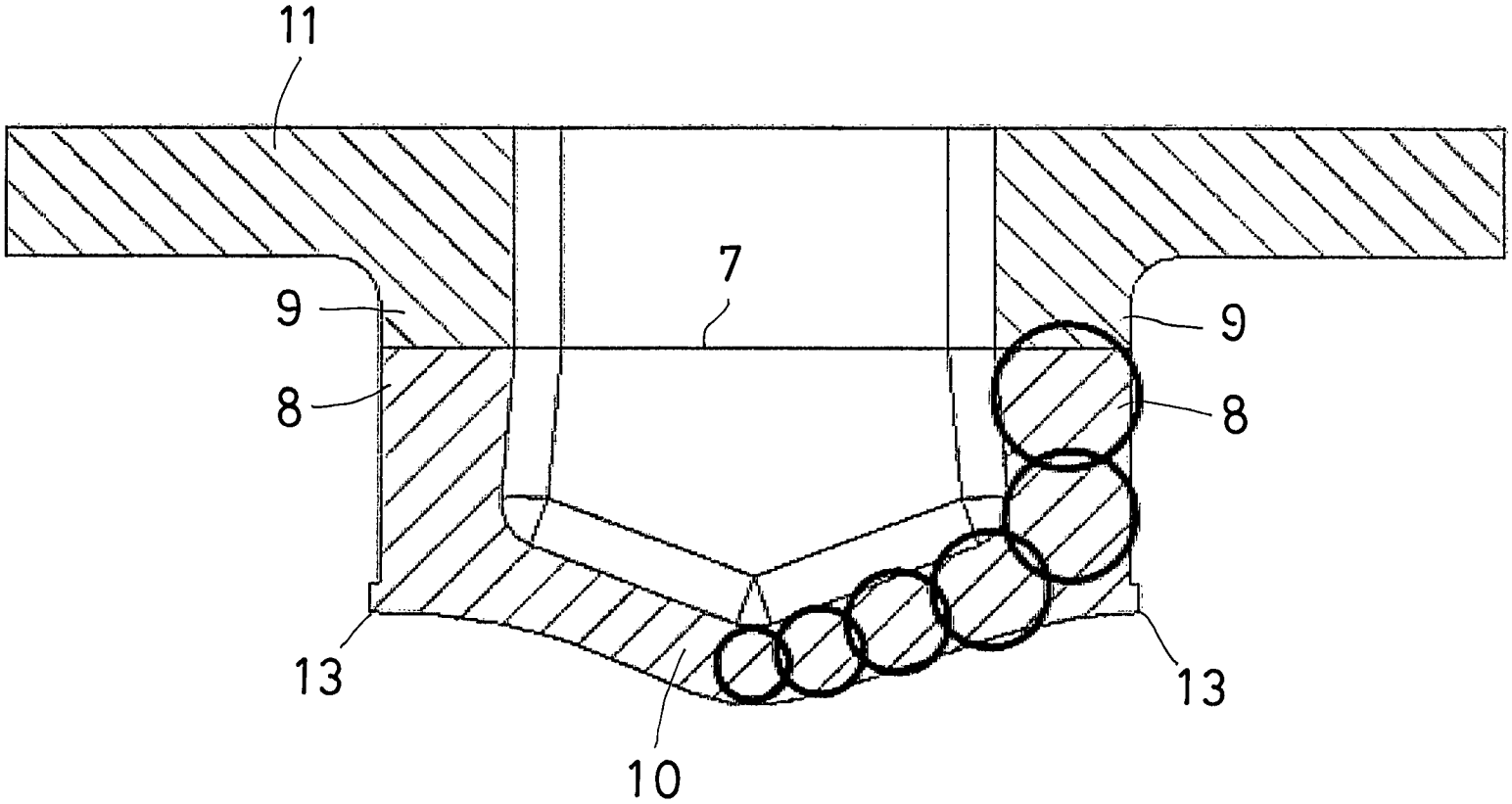
FIG. 6 is a view corresponding to that of FIGS. 4 and 5, but showing an additional alternative tool.

FIG. 6 shows a slightly modified embodiment where the steel portion 10 has two cutting edges 13 and two walls 8 directed towards the grey iron portion 11. Also in this embodiment, the wall thickness of the steel portion 10 declines in a direction away from the dividing plane 7 and is at its least at the maximum distance therefrom. This relationship is clearly apparent from the circles written into the steel portion 10.

The tapering wedge shape downwards, which the steel portions 10 have in the casting position below the dividing plane, i.e. the intended interconnection zone, has not be disclosed in FIGS. 4 to 6 but should lie in the range of between 5 and 30°.

What is claimed is:

1. A composite cast tool which is cast in one continuous piece, comprising:

a first portion comprising a working component of the tool and being manufactured from steel, and one second portion which comprises a body component of the tool and which is manufactured from grey cast iron, wherein the first portion includes a plurality of projections or walls which extend towards the body component, and the second portion includes a plurality discrete of projections or walls which extend towards the working component, corresponding discrete projections or walls and the steel of the first portions and the cast iron of the second portions being united with one another in a plurality of discrete interconnection zones, and wherein the plurality of interconnection zones are substantially planar, wherein the plurality of interconnection zones all lie in a common plane.

2. The composite cast tool as claimed in claim 1, wherein corresponding projections or walls meeting one another at the plurality of interconnection zones have substantially a same cross-sectional configuration and area in a region of the plurality of interconnection zones.

3. The composite cast tool as claimed in claim 1, wherein the plurality of projections or walls of the first portion have a cross-sectional area which declines with increasing distance from the plurality of interconnection zones.

4. The composite cast tool as claimed in claim 1, wherein the plurality of interconnection zones have substantially a same width throughout an entire length of the projections or the walls.

5. The composite cast tool as claimed in claim 1, wherein a least height of the plurality of projections or walls of the first portion is greater than a width of the plurality of interconnection zones.

6. The composite cast tool as claimed in claim 1, wherein a height of the plurality of projections or walls of the second portion is greater than an approximate width of the plurality of interconnection zones.

* * * * *